US011738551B2

(12) United States Patent
Kuno

(10) Patent No.: US 11,738,551 B2
(45) Date of Patent: Aug. 29, 2023

(54) FOIL TRANSFER DEVICE AND METHOD OF TRANSFERRING FOILS

(71) Applicant: DGSHAPE Corporation, Hamamatsu (JP)

(72) Inventor: Tsutomu Kuno, Hamamatsu (JP)

(73) Assignee: DGSHAPE CORPORATION, Shizuoka (JP)

( * ) Notice: Subject to any disclaimer, the term of this patent is extended or adjusted under 35 U.S.C. 154(b) by 308 days.

(21) Appl. No.: 16/452,565

(22) Filed: Jun. 26, 2019

(65) Prior Publication Data

US 2020/0001594 A1 Jan. 2, 2020

(30) Foreign Application Priority Data

Jul. 2, 2018 (JP) ..... 2018-125999

(51) Int. Cl.
*B41F 16/00* (2006.01)

(52) U.S. Cl.
CPC ..... *B41F 16/0093* (2013.01)

(58) Field of Classification Search
CPC ..... B41F 16/0093
USPC ..... 101/488
See application file for complete search history.

(56) References Cited

U.S. PATENT DOCUMENTS

2007/0216975 A1* 9/2007 Holmes ..... B42D 25/328 359/2
2008/0295969 A1* 12/2008 Ohsawa ..... B41F 19/062 156/540
2011/0290139 A1* 12/2011 Puschel ..... B41F 19/06 101/492
2014/0340723 A1* 11/2014 Matsubara ..... B42D 25/328 359/2
2015/0167147 A1* 6/2015 Schupp ..... B41M 5/38207 427/596
2017/0139395 A1* 5/2017 Kobayashi ..... G05B 19/402

FOREIGN PATENT DOCUMENTS

JP 5637371 B2 12/2014

* cited by examiner

*Primary Examiner* — Matthew G Marini
(74) *Attorney, Agent, or Firm* — KEATING & BENNETT, LLP

(57) ABSTRACT

A foil transfer device may include a foil applicator to transfer a foil film onto a substrate, and a controller to transfer, using the foil applicator, foil from one foil film onto a first area of the substrate, the foil film having been placed at a first angle relative to the substrate, and transfer, using the foil applicator, foil from the foil film onto a second area of the substrate, the foil film having been placed at a second angle relative to the substrate, the second angle being different from the first angle, the second area being different from the first area.

7 Claims, 9 Drawing Sheets

FOIL TRANSFER DEVICE AND METHOD OF TRANSFERRING FOILS

CROSS REFERENCE TO RELATED APPLICATIONS

This application claims the benefit of priority to Japanese Patent Application No. 2018-125999 filed on Jul. 2, 2018. The entire contents of this application are hereby incorporated herein by reference.

BACKGROUND OF THE INVENTION

1. Field of the Invention

The present disclosure relates to foil transfer devices and methods of transferring foils.

2. Description of the Related Art

Foil films that have structural color and thus show different colors and/or patterns from different viewing angles are known in the art (Japanese Patent No. 5637371), and devices for and methods of transferring foil from such foil films onto the surfaces of substrates are also known in the art.

In these types of foil films, phenomena such as diffraction, interference, and scattering of reflected light occur due to their surface structures. Accordingly, the foil films are perceived with different colors and/or different patterns when a viewer changes their viewing angle relative to the foil film or when the angle of the foil film to the viewer changes.

One possible method of placing such foil films involves defining two or more areas on a substrate and laying the foil films in these areas with different angles. When such a placement method is used, the foil films are perceived with different colors and/or different patterns from area to area even when viewed from the same angle, allowing a diversity of expressions.

When the placement as mentioned above is used, however, it is necessary to prepare two or more kinds of foil films that are different in angles and transfer them for each area, which could possibly increase transfer costs.

SUMMARY OF THE INVENTION

In view of the aforementioned problem, preferred embodiments of the present invention provide devices for and methods of transferring foil films which contribute to the reduction in transfer costs.

According to a preferred embodiment of the present invention, a foil transfer device includes a foil applicator to transfer foil from a foil film onto a substrate, and a controller. The controller may execute a first transfer process of transferring, using the foil applicator, one foil film onto a first area of the substrate, the foil film having been placed at a first angle relative to the substrate, and a second transfer process of transferring, using the foil applicator, foil from the foil film onto a second area of the substrate, the foil film having been placed at a second angle relative to the substrate, the second angle being different from the first angle, the second area being different from the first area.

According to another preferred embodiment of the present invention, a method of transferring foil from a foil film onto a substrate, the method including a first transfer process of transferring foil from one foil film onto a first area of the substrate, the foil film having been placed at a first angle relative to the substrate, a change process of changing the position of the foil film relative to the substrate to a second angle that is different from the first angle, and a second transfer process of transferring foil from the foil film onto a second area of the substrate, the foil film having been placed at the second angle relative to the substrate, the second area being different from the first area.

According to another preferred embodiment of the present invention, a foil transfer device includes a foil applicator to transfer foil from a foil film onto a substrate, and a controller. The controller may execute a first transfer process of transferring, using the foil applicator, one foil film onto a first area of the substrate, the foil film having been placed at a first angle relative to the substrate, and a second transfer process of transferring, using the foil applicator, the foil film onto a second area of the substrate, the foil film having been placed at a second angle relative to the substrate, the second angle being different from the first angle, at least a portion of the second area overlapping the first area.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
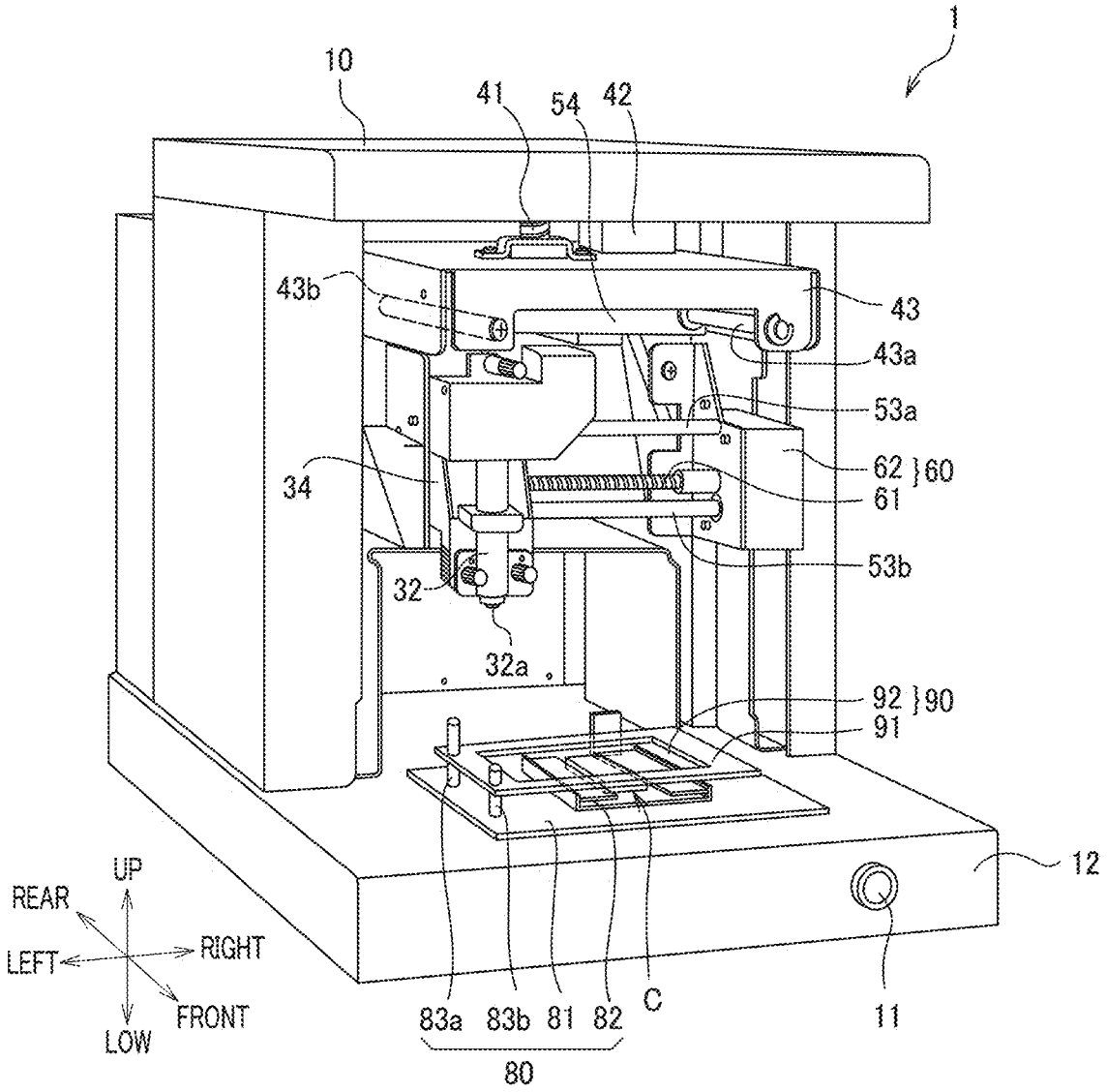
FIG. 1 is an external perspective view of a foil transfer device according to a preferred embodiment of the present invention.

Referring to FIGS. 1 to 7B, a foil transfer device 1 according to a preferred embodiment of the present invention is described. The foil transfer device 1 according to this preferred embodiment transfers foil from a holographic foil F onto a substrate C such that the holographic foil F has a certain shape by making a laser beam be scanned over the substrate C on which the holographic foil F has been laid. As illustrated in FIGS. 1 to 4, the foil transfer device 1 includes a casing 10, a controller 20, a foil applicator 30, an up/low direction driver 40, a front/rear direction driver 50, a left/right direction driver 60, a changer 70, a mounter 80, and a light absorber 90. The foil transfer device 1 is connected to a computer 2 external to it in such a way that they can communicate with each other.

Alternatively, the foil transfer device 1 itself may have the function of the computer 2. The holographic foil F is an example of foil films.

The computer 2 generates data representing a scanning path along the shape of a design (e.g., an outline of a letter) to be transferred onto the substrate C and sends the data to the foil transfer device 1. For the computer 2, for example, an ordinary personal computer can be used. Scanning paths are created using a certain program that has been installed on the computer 2.

Figure 2:
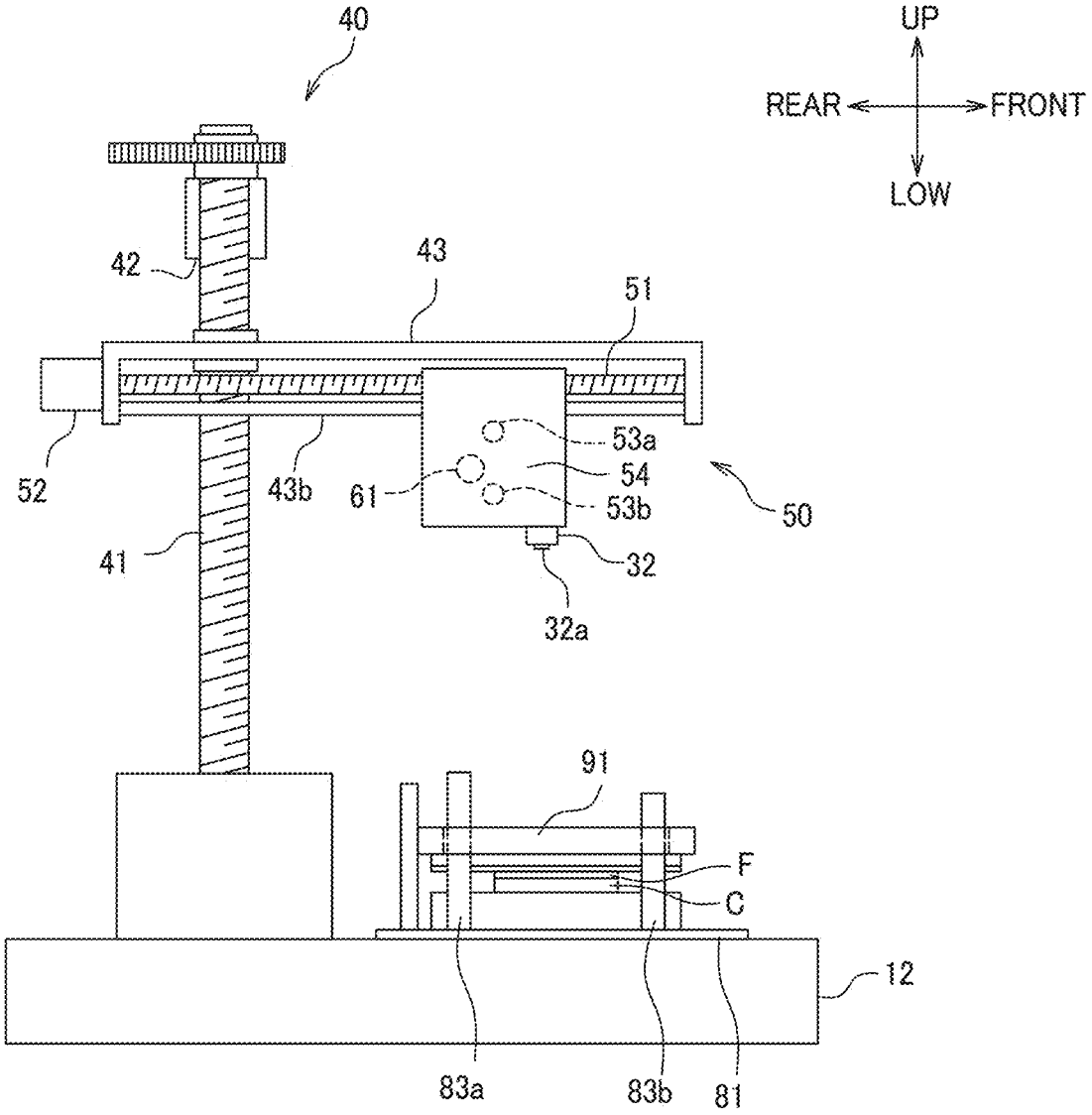
FIG. 2 is a left side view diagrammatically showing drivers according to a preferred embodiment of the present invention.

As illustrated in FIGS. 1 and 2, the casing 10 includes a base 12. A power switch 11 that is electrically connected to the controller 20 is provided on the base 12. The mounter 80 is fixed to the upper surface of the base 12.

In this preferred embodiment, front/rear, left/right, and up/low directions are defined as illustrated in FIG. 1. Specifically, the portion of the casing 10 which the power switch 11 is on is considered as the front and the portion that is opposite to the front is considered as the rear. Right and left are defined as seen from the front of the casing 10. The side of the casing 10 where the base 12 is located is considered as the lower side and the side that is opposite to the lower side is considered as the upper side.

Figure 4:
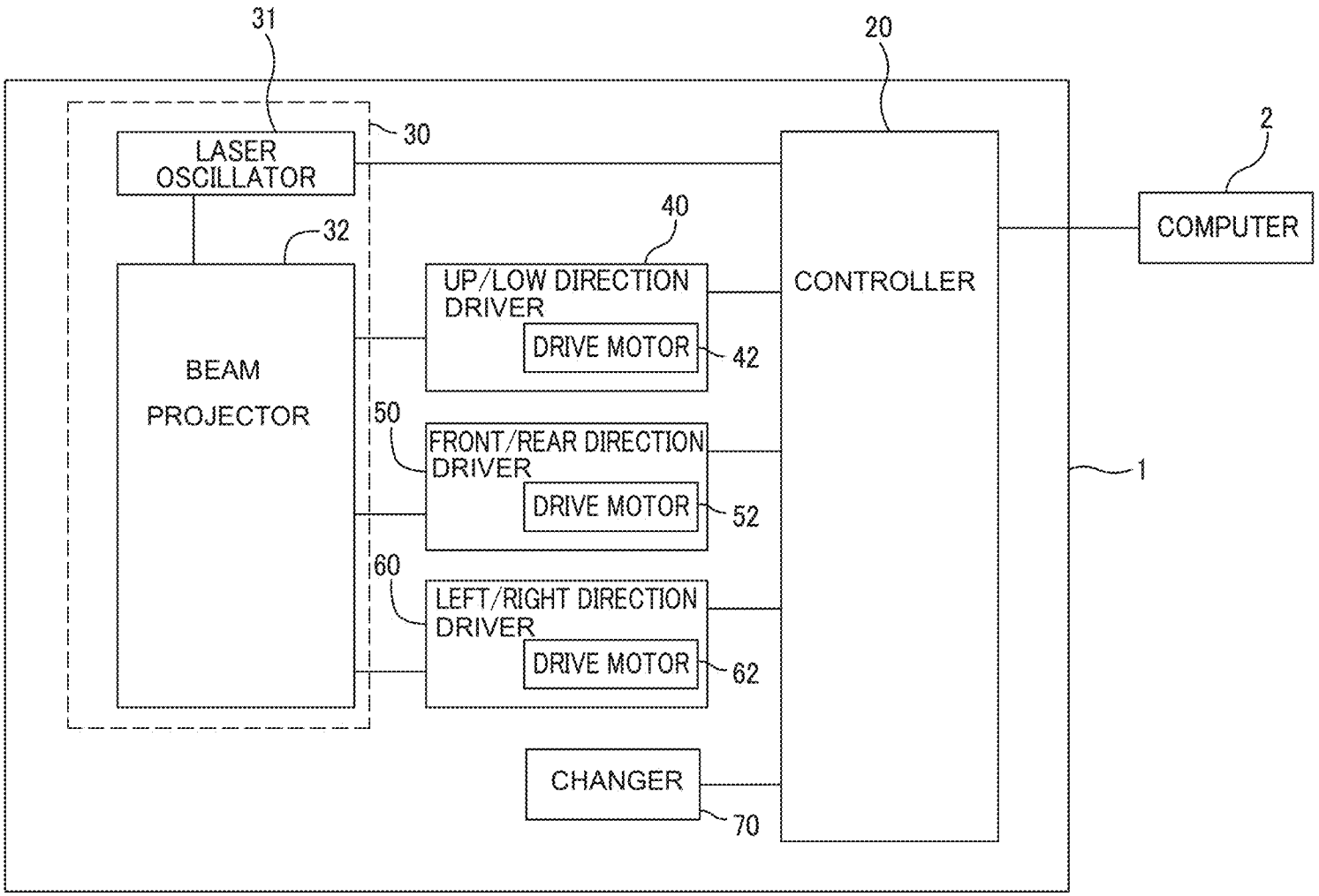
FIG. 4 is a block diagram illustrating functional connections in a foil transfer device according to a preferred embodiment of the present invention.

Operation of the entire foil transfer device 1 is controlled by the controller 20. As illustrated in FIG. 4, the controller 20 is configured or programmed to control the foil applicator 30, the up/low direction driver 40, the front/rear direction driver 50, and the left/right direction driver 60 with being connected to them in such a way that the controller 20 can communicate with them. The controller 20 may have any configuration but, in this preferred embodiment, it mainly has a read-only memory (ROM) in which programs are stored, a central processing unit (CPU) that executes programs, a random-access memory (RAM) that provides a work area for the CPU to perform functions, and a non-volatile random-access memory (NVRAM) that retains data.

As illustrated in FIGS. 1 to 4, the foil applicator 30 is provided in the casing 10. The foil applicator 30 includes a laser oscillator 31, a beam projector 32, an optical fiber 33, and a carriage 34.

Figure 3:
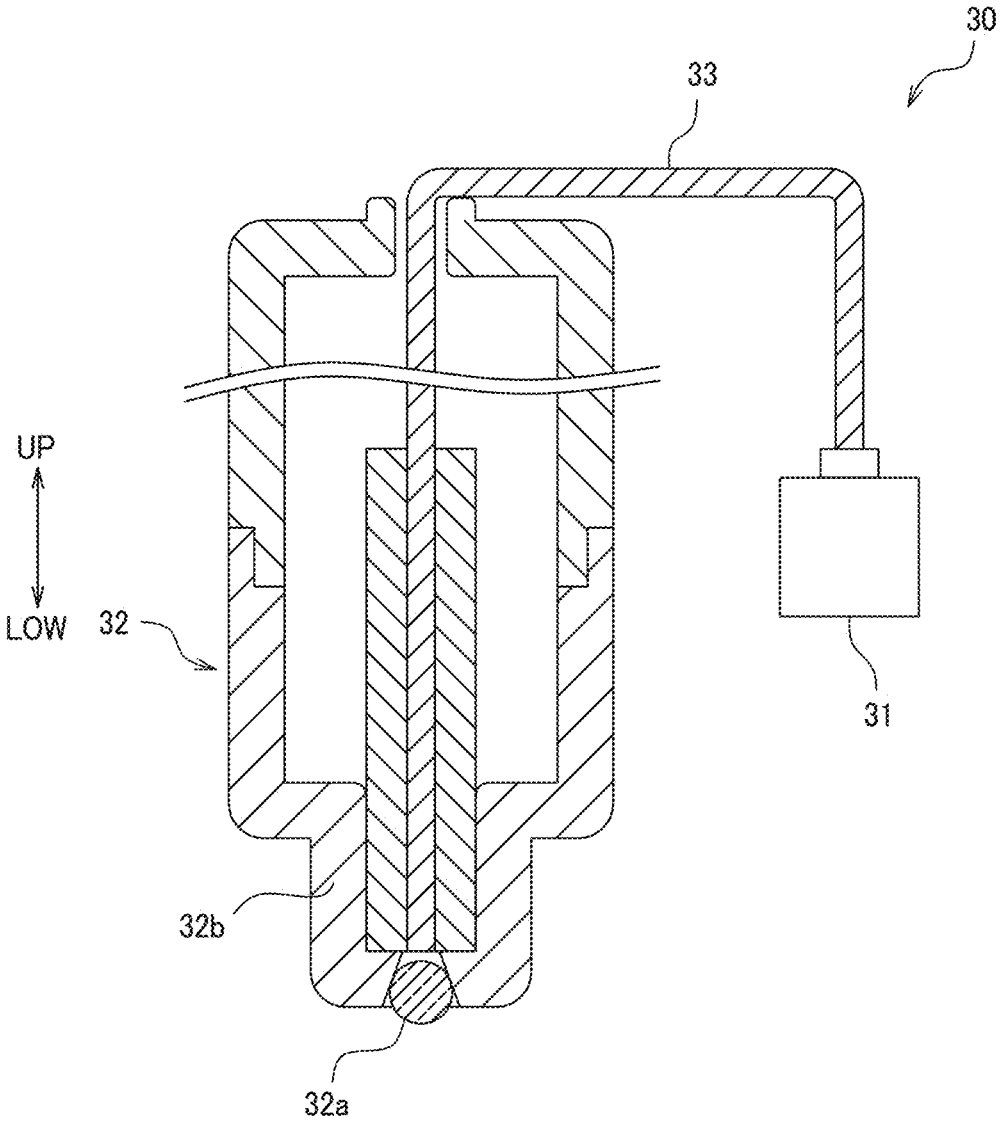
FIG. 3 is a diagrammatic representation of a foil applicator according to a preferred embodiment of the present invention from which a carriage is omitted.

The laser oscillator 31 is a semiconductor laser oscillator (FIG. 3). Electric current passing through the laser oscillator 31 produces a laser beam which emerges from the laser oscillator 31. Regarding the capability of the laser oscillator 31, it provides, for example, up to about 1 W of output power at about 450 nm. It should be noted that the laser oscillator 31 is not limited to a semiconductor laser; instead, a solid-state laser or a gas laser can also be used.

As illustrated in FIG. 3, the beam projector 32 is connected to the laser oscillator 31 via the optical fiber 33. The beam projector 32 includes a lens 32*a* and a substantially circular pipe 32*b* that extends vertically and carries the lens 32*a* at its lower portion.

The lens 32*a* in this preferred embodiment is made of a material transparent to laser beams and has a spherical shape. It should be noted that the lens 32*a* is not limited to a spherical one and may have a lens shape or hemispherical shape. The laser beam emerging from the laser oscillator 31 is guided to the beam projector 32 through the optical fiber 33 and projected out through the lens 32*a*. Transfer of the holographic foil F is achieved by pressing the lens 32*a* against the holographic foil F and the substrate C through the light absorber 90 and projecting a laser beam.

As illustrated in FIG. 1, the carriage 34 holds the beam projector 32 on the front side of the carriage 34. The carriage 34 is held in such a way that it can be driven by the left/right direction driver 60, the front/rear direction driver 50, and the up/low direction driver 40. With these drivers, the carriage 34 and the beam projector 32 held by the carriage 34 can move in a 3D direction relative to the substrate C.

As illustrated in FIGS. 1 and 2, the up/low direction driver 40 includes an up/low direction drive shaft 41, a drive motor 42, and an up-and-down base 43. The up/low direction drive shaft 41 extends vertically and has a spiral thread running around it. Upper and lower portions of the up/low direction drive shaft 41 are supported by the casing 10 and the base 12, respectively, in a spinnable manner. The drive motor 42 is fixed to an upper portion of the casing 10 and is electrically connected to the controller 20. The output shaft of the drive motor 42 is mechanically connected to the up/low direction drive shaft 41 and can spin and drive the up/low direction drive shaft 41.

The up-and-down base 43 extends horizontally and is slidably supported by a vertically-extending slide shaft which is not illustrated. The up-and-down base 43 is in engagement with the spiral thread of the up/low direction drive shaft 41. When the up/low direction drive shaft 41 turns, the up-and-down base 43 moves vertically. The up-and-down base 43 includes slide shafts 43*a* and 43*b* that extend in the front/rear direction.

The front/rear direction driver 50 includes a front/rear direction drive shaft 51, a drive motor 52, and a slide base 54. The front/rear direction drive shaft 51 is attached to the up-and-down base 43 in such a way that it extends in the front/rear direction and has a spiral thread running around it. The drive motor 52 is fixed to a rear portion of the up-and-down base 43 and is electrically connected to the controller 20. The output shaft of the drive motor 52 is connected to the rear end of the front/rear direction drive shaft 51 and can rotate the front/rear direction drive shaft 51.

The slide base 54 is in engagement with the spiral thread of the front/rear direction drive shaft 51. The slide base 54 is slidably supported by the slide shafts 43*a* and 43*b*. When the drive motor 52 is activated, the front/rear direction drive shaft 51 turns and the slide base 54 moves in the front/rear direction. The slide base 54 includes slide shafts 53*a* and 53*b* that extend in the left/right direction.

The left/right direction driver 60 is coupled to the slide base 54. The left/right direction driver 60 includes a left/right direction drive shaft 61 and a drive motor 62. The left/right direction drive shaft 61 extends in the left/right direction and has a spiral thread running around it. The output shaft of the drive motor 62 is mechanically connected to the right-hand end of the left/right direction drive shaft 61 and can rotate the left/right direction drive shaft 61. The drive motor 62 is electrically connected to the controller 20.

The left/right direction drive shaft 61 is in engagement with the spiral thread of the carriage 34. The slide shafts 53*a* and 53*b* slidably support the carriage 34. When the drive motor 62 is activated, the left/right direction drive shaft 61 turns and the carriage 34 is activated in the left/right direction along the slide shafts 53*a* and 53*b*.

As illustrated in FIG. 4, the changer 70 changes the placement angle of the holographic foil F placed on the substrate C. The changer 70 includes a motor for control and the output shaft of the motor is used as motive power to move or change the angle of the holographic foil F. The changer 70 is electrically connected to the controller 20 and its operation is controlled by the controller 20.

As illustrated in FIGS. 1 and 2, the mounter 80 includes a plate-shaped workbench 81 secured to the top of the base 12, a vise 82 that is removably fixed to the workbench 81, and supports 83*a* and 83*b*. The vise 82 in this preferred embodiment includes a pair of members on the right and left sides and firmly holds the substrate C. The vise 82 secures the substrate C on the base 12 by clamping the substrate C from its right and left sides.

Each of the supports 83*a* and 83*b* is a substantially cylindrical member that is secured to the workbench 81 at its lower end and extends upward. An upper portion of the support 83*a* pivotally holds the light absorber 90.

The light absorber 90 includes a frame 91 and a film 92. The frame 91 is a frame-shaped member which looks like a rectangle when seen from the above and holds the film 92. The film 92 absorbs beams of light such as laser beams.

Figure 5A:
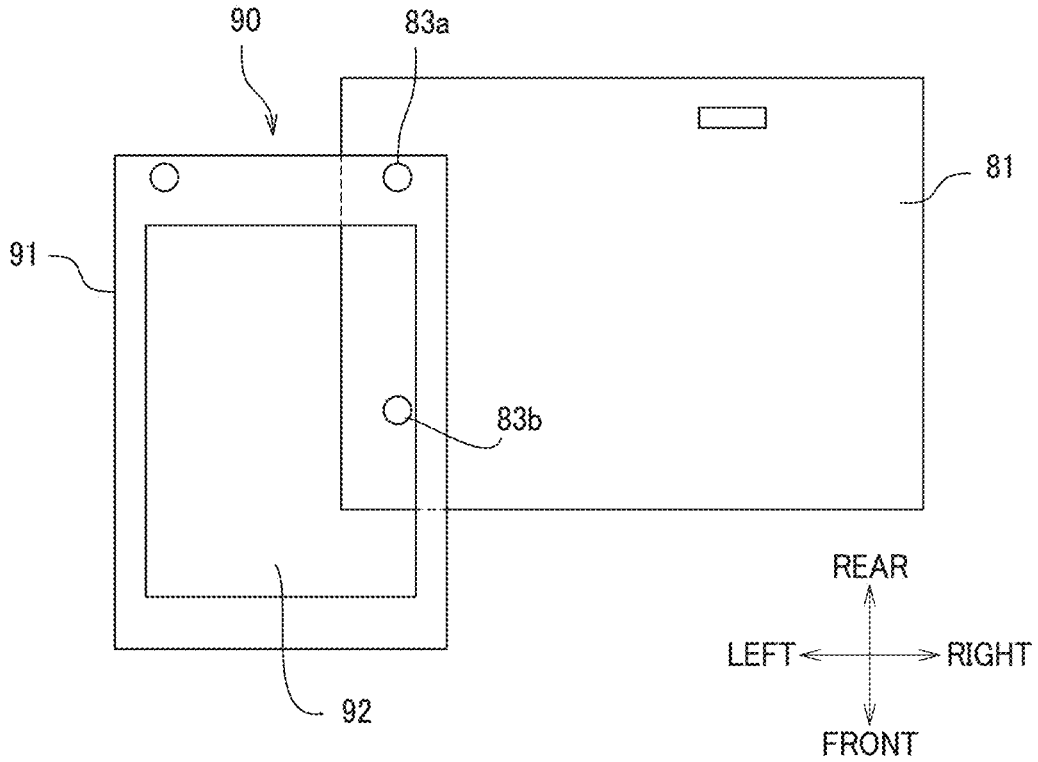
FIGS. 5A and 5B show top views of a mounter and a light absorber according to a preferred embodiment of the present invention, with the light absorber being illustrated in FIG. 5A in a standby position and in FIG. 5B in a loading position, in which a vise is not illustrated for easier understanding.
Figure 5B:
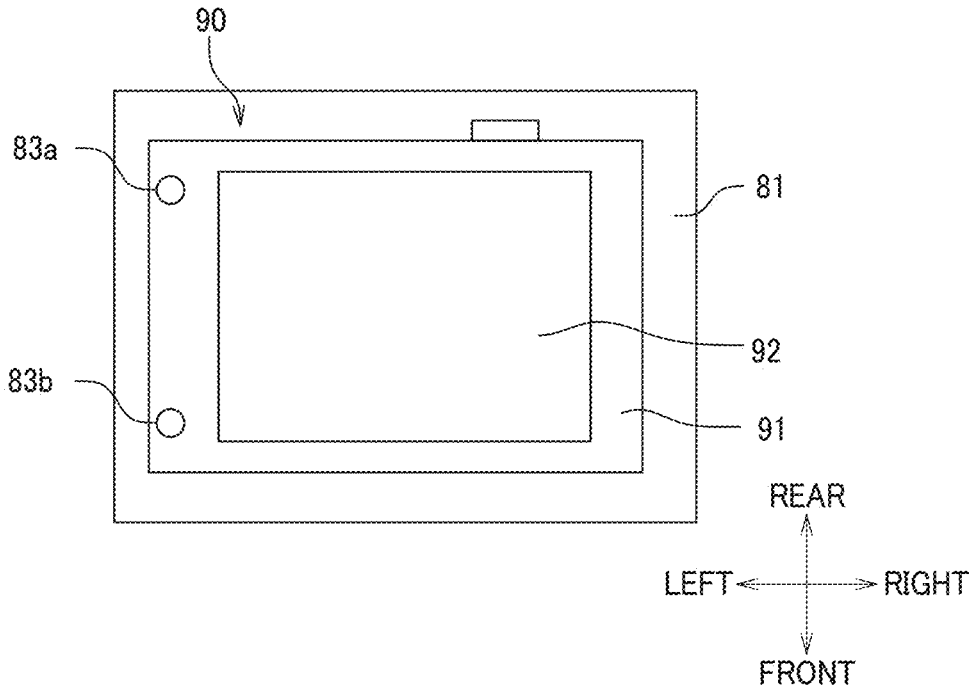

As illustrated in FIGS. 5A and 5B, the light absorber 90 is pivotally held by the support 83*a* and can turn substantially horizontally between a standby position (FIG. 5A) and a loading position (FIG. 5B). When the light absorber 90 comes to the loading position, the frame 91 engages with the support 83*b* and thus the light absorber 90 is kept from moving at the loading position.

The holographic foil F has a surface structure which is responsible for phenomena such as diffraction, interference, and scattering of reflected light. Thus, the holographic foil F is typically anisotropic because of its surface structure. When the direction of viewing or viewing angle relative to the holographic foil F is changed, or when the direction or angle of the holographic foil F relative to the observer is changed, the color and/or pattern of the holographic foil F can be perceived as being changed.

The substrate C includes a substantially rectangular parallelepiped housing. The housing of the substrate C is made of a resin; specifically, it is formed of, for example, acrylic, ABS, polypropylene, polystyrene, or polycarbonate.

Figure 7A:
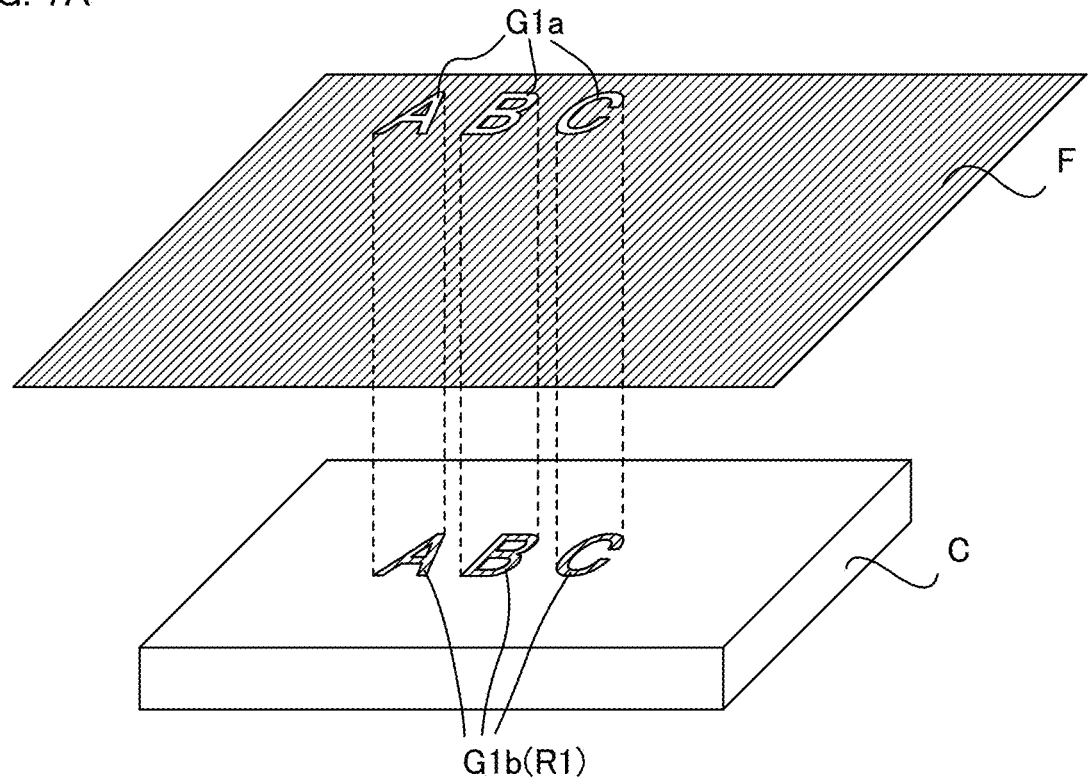
FIGS. 7A and 7B are diagrammatic representations showing a relationship between a holographic foil and a substrate in FIG. 7A a first transfer process and in FIG. 7B a second transfer process according to a preferred embodiment of the present invention.
Figure 7B:
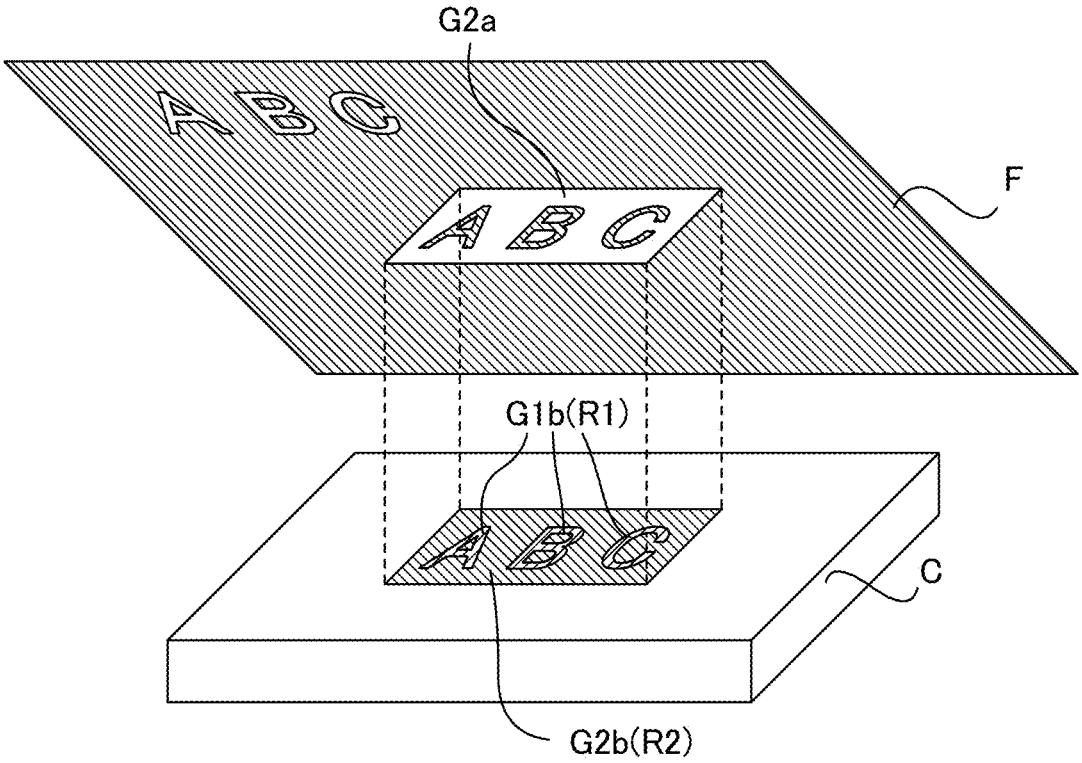

An operation in transferring foil from the holographic foil F onto the substrate C using the foil transfer device 1 is described in detail below. For the purpose of facilitating the understanding, as a specific example of the transfer operation, an operation to transfer foil from the holographic foil F illustrated in FIGS. 7A and 7B successively onto each of first areas R1 and an adjacent second area R2 of the substrate C according to designs G1*a* and a design G2*a* is described. In this transfer operation, the eventual result is that designs G1*b* are formed in the respective first areas R1 of the substrate C and a design G2*b* is formed in the second area R2 of the substrate C (FIG. 7B).

In the transfer operation, first, the user places the light absorber 90 at the standby position (FIG. 5A). Next, the user secures the substrate C by clamping it with the vise 82 so that the substrate C is immobile relative to the base 12. After the substrate C has been secured, the user places the holographic foil F to cover the substrate C. Further, the user turns the light absorber 90 from the standby position to the loading position (FIG. 5B) to complete loading of the substrate C and the holographic foil F. After the completion of the loading of the substrate C and the holographic foil F, the user enters, using the computer 2, the designs G1*a* and G2*a* to be transferred and an angle used in the angle change process (described later) to instruct the controller 20 to start operations.

Figure 6:
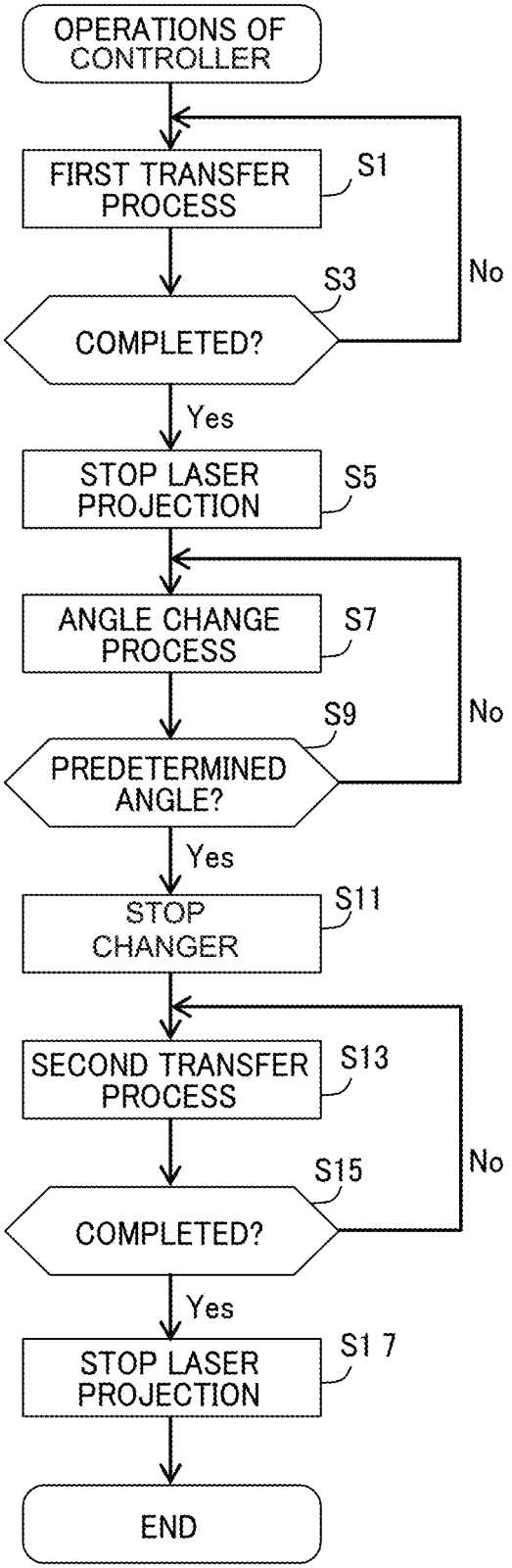
FIG. 6 is a flow chart illustrating a transfer operation performed by a controller according to a preferred embodiment of the present invention.

In response to the instruction from the user, the controller 20 performs the operation illustrated in FIG. 6. The casing 10 may thereon have an operator for the operation of the controller 20.

A sequence of operations performed by the controller 20 is described below with reference to FIG. 6. In step S1, the controller 20 starts performing a first transfer process. The first transfer process transfers the designs G1*a* onto the respective first areas R1 of the substrate C. In the first transfer process, the controller 20 controls the up/low direction driver 40, the front/rear direction driver 50, and the left/right direction driver 60 to move the beam projector 32 according to the shape of each design G1*a*.

Concurrently, the controller 20 activates the laser oscillator 31 to project a laser beam through the lens 32*a* of the beam projector 32. At the time mentioned, the lens 32*a* is in contact with the film 92 and is pressed against the film 92, the holographic foil F, and the substance C by a spring which is not illustrated. The laser beam is projected onto the holographic foil F through the film 92. The portion of the holographic foil F exposed to the laser beam is heated and the foil at the portion is transferred onto a first area R1 of the substrate C.

In step S3, the controller 20 checks whether all designs G1*a* that should be formed have been formed. If the formation of designs G1*a* has not yet been completed (S3: No), the controller 20 returns the operation to the step S1 to continue the first transfer process.

If it is determined that the transfer of all designs G1*a* has been completed (S3: Yes), the controller 20 deactivates the laser oscillator 31 to stop the projection of the laser beam (S5). In this way, the controller 20 terminates the first transfer process.

The controller 20 performs, in step S7, an angle change process. The controller 20 controls the changer 70 to turn the holographic foil F in a substantially horizontal direction to change an angle relative to the substrate C. Alternatively, the controller 20 controls the changer 70 to move the holographic foil F in the front/rear and left/right directions while turning it. With the aforementioned operation, a relative angle of the holographic foil F to the substrate C is changed.

The controller 20 judges, in step S9, whether the turn angle of the holographic foil F reaches a predetermined angle. The controller 20 returns the operation to the step S7 if it determines that the turn angle of the holographic foil F has not yet reached the predetermined angle (S9: No) to continue the angle change process for the holographic foil F.

If the controller 20 determines that the turn angle has reached the predetermined angle (S9: Yes), the controller 20 stops controlling the changer 70 (S11) and starts performing the second transfer process (S13). As a result of the angle change process, the angle of the holographic foil F relative to the substrate C is changed from a first angle illustrated in FIG. 7A to a second angle illustrated in FIG. 7B.

The second transfer process transfers foil from the holographic foil F to form the design G2*a* onto the second area R2 of the substrate C. The controller 20 activates, in the second transfer process, the laser oscillator 31 and projects a laser beam from the beam projector 32. At the same time, the controller 20 moves the beam projector 32 to transfer foil to form the design G2*a* onto the second area R2.

In step S15, the controller 20 checks whether the transfer of the design G2*a* has been completed. If the controller 20 determines that the formation of the design G2*a* has not yet been completed (S15: No), it returns the operation to the step S13 to continue the transfer operation.

If the controller 20 determines that the formation of the design G2*a* has been completed, the controller 20 stops the laser oscillator 31 to stop the projection of the laser beam (S17). In this way, the controller 20 completes the second transfer process.

While the configuration in which the laser oscillator 31 is used as a light generator for transfer has been described in this preferred embodiment, the present disclosure is not limited to such a configuration. For example, in place of the laser oscillator 31, a light-emitting diode may be used. Alternatively, not limited to the light-emitting diodes, the foil transfer device 1 may use elements or similar devices of which light output can be changed by changing the electric current flowing therethrough. The foil applicator 30 may also use a mechanism compatible with hot stamping methods or heat pen methods. Transfer operations may be performed without using the light absorber 90.

In this preferred embodiment, the changer 70 is used for the angle change process for the holographic foil F. The present disclosure, however, is not limited to such a configuration. After the completion of the first transfer process, the user may manually perform the angle change process. In this case, the user turns the light absorber 90, places the light absorber 90 at the standby position (FIG. 5A), and horizontally moves the holographic foil F, thus changing the angle relative to the substrate C. Then, the light absorber 90 is returned to the loading position (FIG. 5B) and the second transfer process is started.

While this preferred embodiment has been described in conjunction with a case in which only the beam projector 32 is moved, the present disclosure is not limited to such a structure. That is, foil transfer may be performed by moving, relative to the fixed beam projector 32, the mounter 80 in the front/rear, left/right, and up/low directions. In this case, the up/low direction driver 40, the front/rear direction driver 50, and the left/right direction driver 60 include a structure to drive the mounter 80 (for example, a drive motor for moving the mounter 80 in three axial directions). Alternatively, both of the beam projector 32 and the mounter 80 may be moved.

In the present preferred embodiment, the first areas R1 and the second area R2 are adjacent to each other, and the designs G1*b* and the design G2*b* are adjacent to each other. The present disclosure, however, is not limited to this preferred embodiment. The first areas R1 and the second area R2 may be positioned so that at least a portion thereof overlaps.

Figure 8A:
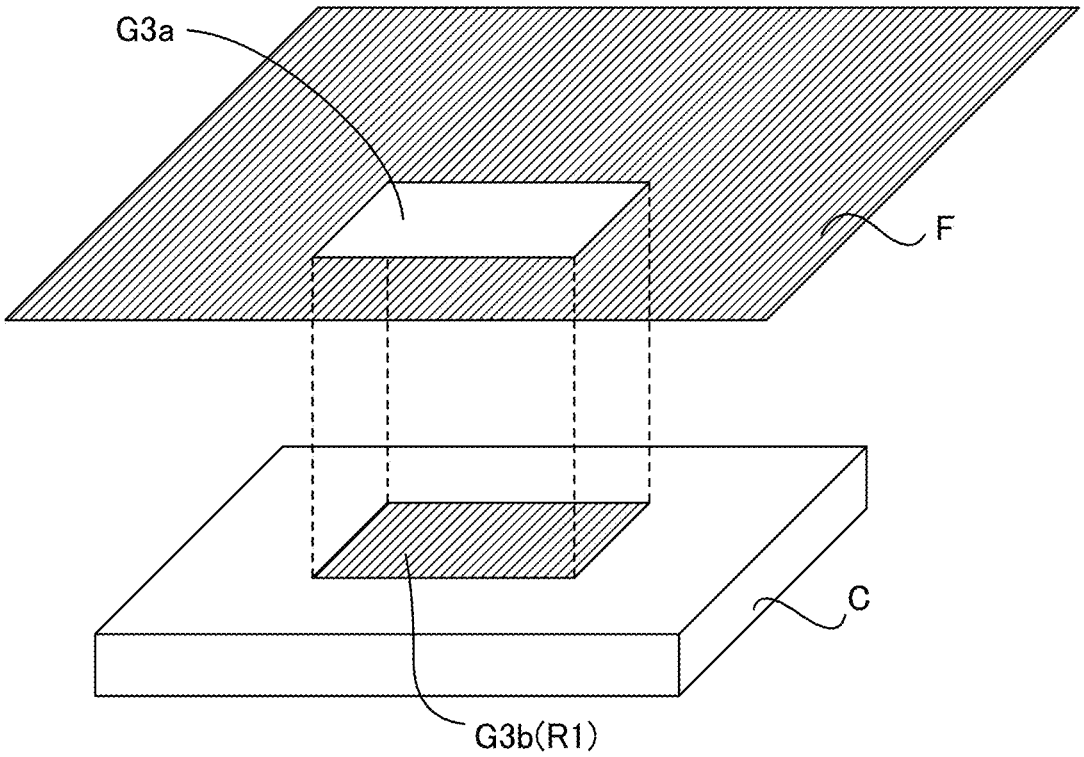
FIGS. 8A and 8B are diagrammatic representations showing a relationship between a holographic foil and a substrate in FIG. 8A a first transfer process and in FIG. 8B a second transfer process according to a first modification of a preferred embodiment of the present invention.
Figure 8B:
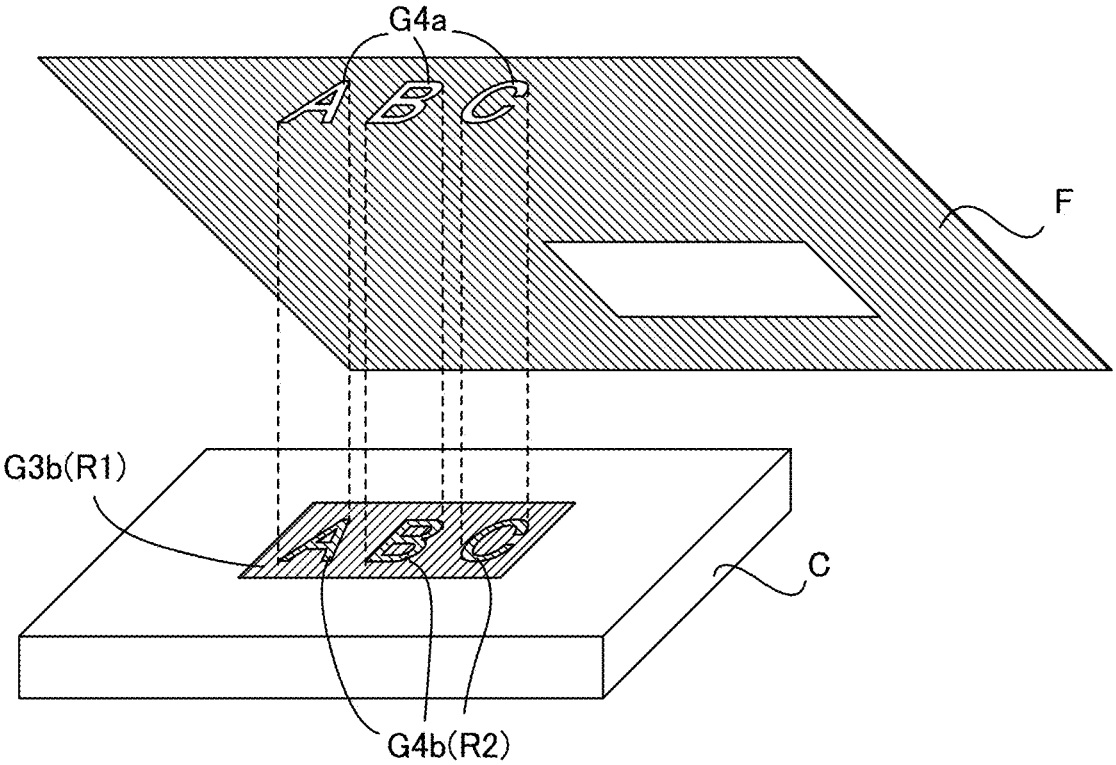

As illustrated in FIGS. 8A and 8B, as a first modification, designs G4*b* may be formed so that second areas R2 are located inside a first area R1 and the designs G4*b* overlap a design G3*b*. Even in this case, the design G3*b* and the designs G4*b* are perceived with different colors and/or patterns because foil of the holographic foil F has been transferred to form the designs at angles different from each other.

Figure 9A:
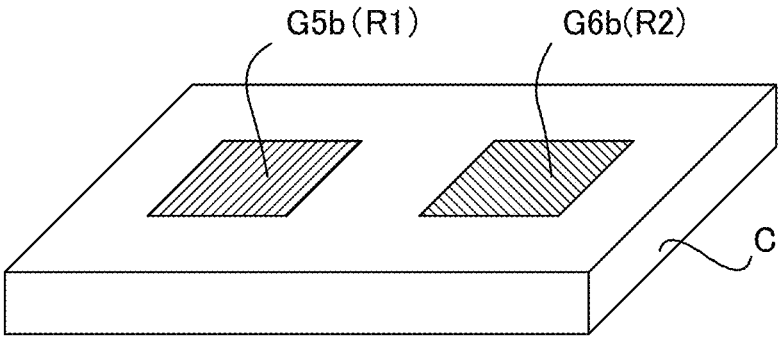
FIGS. 9A to 9C show substrates after having been subjected to a transfer operation according to FIG. 9A in a second modification of a preferred embodiment of the present invention, FIG. 9B in a third modification of a preferred embodiment of the present invention, and FIG. 9C in a fourth modification of a preferred embodiment of the present invention.
Figure 9B:
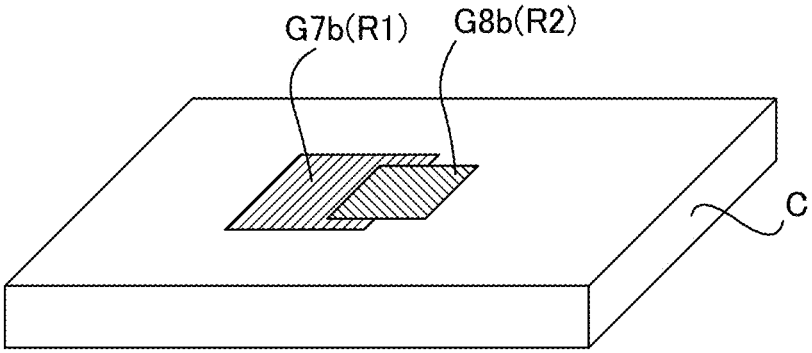

As illustrated in FIG. 9A, as a second modification, a first area R1 and a second area R2 may be spaced apart from each other, and a design G5*b* and a design G6*b* may be formed. Alternatively, as illustrated in FIG. 9B, as a third modification, a first area R1 and a second area R2 may be positioned so that they partially overlap and a design G7*b* and a design G8*b* may be formed. Even in these cases, the designs formed on the substrate C are perceived with different colors and/or patterns because foil of the holographic foil F has been transferred to form designs at angles different from each other.

Figure 9C:
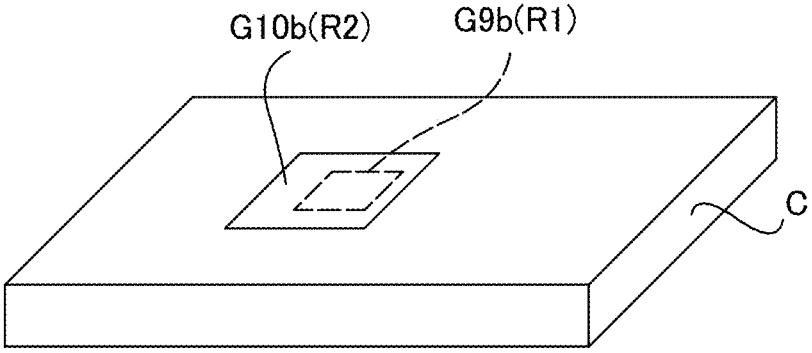

Furthermore, as illustrated in FIG. 9C, as a fourth modification, a first area R1 may be located inside a second area R2, and a design G10*b* may be formed so as to cover a design G9*b*. When the hologram foil F is transparent to light, the design G9*b* underneath the design G10*b* is visible. In this case, the design G9*b* and the design G10*b* are perceived with different colors and/or patterns because foil of the holographic foil F has been transferred to form designs at angles different from each other.

The foil film in example embodiments of the present disclosure is not limited to the holographic foil F. The foil film may have a known metallic foil, a magic mirror foil, a pigmented foil, a multicolor printing foil or the like, instead of holographic foils.

It should be noted that the material of the substrate in the present disclosure is not limited to resin, and may be formed of other materials such as a metal and pottery. Furthermore, the shape of the casing of the substrate in the present disclosure is not limited to a rectangular parallelepiped shape as in the present preferred embodiment, and each side surface may be formed by a curved surface.

As described above, the foil transfer device 1 according to this preferred embodiment includes the foil applicator 30 capable of transferring foil from the holographic foil F onto the substrate C, and the controller 20. The controller is capable of executing the first transfer process of transferring, using the foil applicator 30, foil from one holographic foil F which has been placed at a first angle relative to the substrate C, onto the first area R1 of the substrate C, and a second transfer process of transferring, using the foil applicator 30, foil from the holographic foil F which has been placed at a second angle relative to the substrate C, onto the second area R2 of the substrate C, in which the second angle is different from the first angle and the second area is different from the first area.

In addition, the foil transfer device 1 also includes the changer 70 capable of changing the position of the holographic foil F relative to the substrate C, and the controller 20 is capable of further executing a change process of changing, using the changer 70, the position of the holographic foil F from the first angle to the second angle.

In the foil transfer device 1 having the aforementioned structure and the transfer method using the foil transfer device 1, a single holographic foil F is used, and transfer operations are performed by changing the angles of the holographic foil F relative to the substrate C from area to area. Accordingly, it is unnecessary to prepare two or more holographic foils F that are different in angles from each other, which contributes to the reduction in transfer costs.

The foil applicator 30 of the foil transfer device 1 includes the beam projector 32 that emits laser beams.

As conventional methods of transferring foil from foil films (foil stamping methods), hot stamping and heat pen systems are known. In the hot stamping method, a mold (plate) is pressed against the foil on which adhesive has been deposited so that the foil is thermally transferred to substrate under high temperature and pressure. Heat pen systems use a heated pen. Such conventional foil transfer methods are difficult to apply to resin products that are vulnerable to high temperatures.

On the other hand, the foil transfer device 1 having the aforementioned structure heats each foil film by projecting a narrow laser beam while controlling it. Accordingly, the foil transfer device 1 is able to transfer foil from the foil films such as the holographic foil F even onto resin products such as the substrate C.

The foil transfer device 1 includes the light absorber 90 that absorbs laser beams, and the controller 20 projects, onto the holographic foil F through the light absorber 90, laser beams that have been emitted from the beam projector 32 in the first transfer process and the second transfer process.

According to the aforementioned configuration, the light absorber 90 equalizes light absorptance on the holographic foil F and equalize the heat applied to the holographic foil F at a transfer position. Therefore, even when different areas on the surface of the foil have different light absorptances, uneven transfer is reduced or prevented.

The holographic foil F according to the aforementioned configuration has structural color. According to the aforementioned configuration, the holographic foil F is perceived with different colors and/or patterns from area to area that have been subjected to transfer, allowing a diversity of representations.

In the first preferred embodiment, each of the first areas R1 and the second area R2 are adjacent to each other. When each of the first areas R1 and the second area R2 are adjacent to each other, a visual effect such that the transferred designs G1*b* are floating on the background design G2*b* is able to be obtained.

The foil transfer device 1 according to this preferred embodiment includes the foil applicator 30 capable of transferring foil from the holographic foil F onto the substrate C and the controller 20. The controller 20 is capable of executing the first transfer process of transferring, using the foil applicator 30, foil from one holographic foil F onto a first area R1 of the substrate C, the holographic foil F having been placed at a first angle relative to the substrate C; and the second transfer process of transferring, using the foil applicator 30, foil from the holographic foil F onto a second area R2 of the substrate C, the holographic foil F having been placed at a second angle relative to the substrate C, the second angle being different from the first angle, at least a portion of the second area R2 overlapping the first area R1.

In the foil transfer device 1 having the aforementioned structure, transfer operations are performed in two areas using the single holographic foil F. Accordingly, it is unnecessary to prepare two or more holographic foils F, which contributes to the reduction in transfer costs.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A foil transfer device comprising:

a foil applicator to transfer foil from a foil film onto a substrate;

a changer to change a position of the foil film relative to the substrate; and a controller configured or programmed to execute:

a first transfer process to transfer, using the foil applicator, foil from a foil film onto a first area of the substrate, the foil film having been placed on the substrate;

a change process of changing, using the changer, the position of the foil film to a relative angle that is changed from that of the first transfer process; and a second transfer process to transfer, using the foil applicator, foil from the foil film onto a second area of the substrate, the foil film having been placed by the changer during the change process at the relative angle relative to the substrate, the second area being different from the first area.

2. The foil transfer device according to claim 1, wherein the foil applicator includes a beam projector that emits a laser beam.

3. The foil transfer device according to claim 2, further comprising a light absorber that absorbs the laser beam; wherein the controller projects, onto the foil film through the light absorber, the laser beam that has been emitted from the beam projector in the first transfer process and the second transfer process.

4. The foil transfer device according to claim 1, wherein the foil film includes structural color.

5. The foil transfer device according to claim 1, wherein the foil film includes a holographic foil.

6. The foil transfer device according to claim 1, wherein the first area and the second area are adjacent to each other.

7. A foil transfer device comprising:

a foil applicator to transfer foil from a foil film onto a substrate;

a changer to change a position of the foil film relative to the substrate; and a controller configured or programmed to execute:

a first transfer process to transfer, using the foil applicator, foil from a foil film onto a first area of the substrate, the foil film having been placed on the substrate;

a change process of changing, using the changer, the position of the foil film to a relative angle that is changed from that of the first transfer process; and a second transfer process to transfer, using the foil applicator, foil from the foil film onto a second area of the substrate, the foil film having been placed by the changer during the change process at the relative angle relative to the substrate, at least a portion of the second area overlapping the first area.

* * * * *